United States Patent [19]

Hilbert et al.

[11] 4,164,623

[45] Aug. 14, 1979

[54] AM STEREO RECEIVER WITH IMPROVED CORRECTION SIGNALS

[75] Inventors: Francis H. Hilbert, Addison; Norman W. Parker, Wheaton, both of Ill.

[73] Assignee: Motorola, Inc., Schaumburg, Ill.

[21] Appl. No.: 852,272

[22] Filed: Nov. 17, 1977

[51] Int. Cl.[2] ..... H04H 5/00

[52] U.S. Cl. ..... 179/1 GS; 325/419; 329/122

[58] Field of Search ..... 179/15 BT, 1 GS; 325/36, 419, 60, 456; 329/122, 124

[56] References Cited

U.S. PATENT DOCUMENTS

| | | | |
|---|---|---|---|
| 3,068,475 | 12/1962 | Avins | 179/15 BT |
| 3,896,272 | 7/1975 | Takahashi et al. | 179/15 BT |
| 3,934,087 | 1/1976 | Takahashi et al. | 179/15 BT |
| 4,037,165 | 7/1977 | Ogita | 179/15 BT |
| 4,047,116 | 9/1977 | Ogita | 179/15 BT |
| 4,093,824 | 6/1978 | Grosjean | 179/15 BT |

*Primary Examiner*—Douglas W. Olms
*Attorney, Agent, or Firm*—Margaret Marsh Parker; James W. Gillman

[57] ABSTRACT

An AM receiver for receiving a compatible stereo signal and requiring a dynamic correction factor prevents the introduction of a false phase reference signal by limiting and filtering the signal going into the oscillator of the PLL which provides the correction reference signal.

7 Claims, 1 Drawing Figure

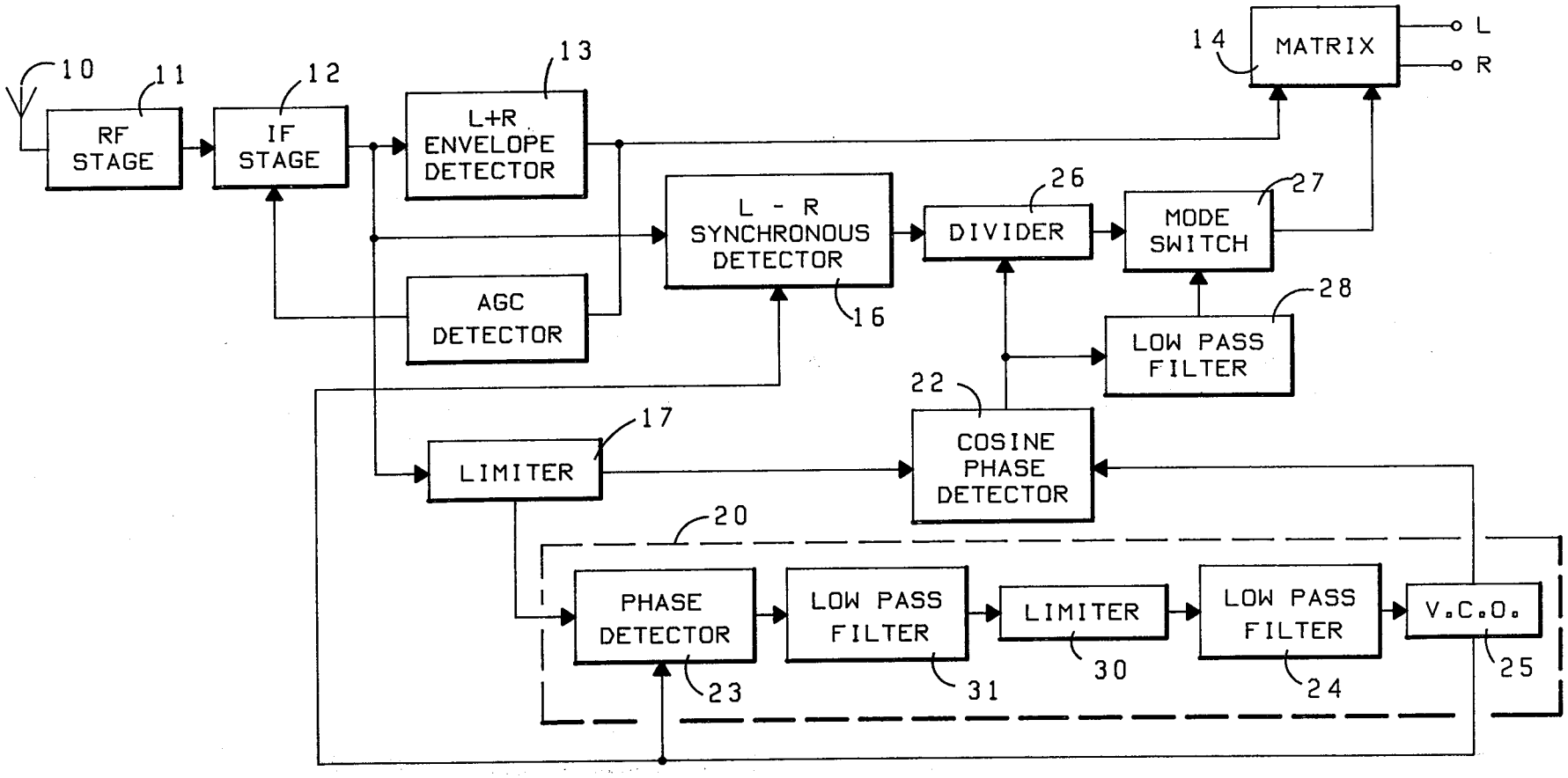
L
R
MATRIX
14
MODE SWITCH
27
LOW PASS FILTER
28
DIVIDER
26
COSINE PHASE DETECTOR
22
L - R SYNCHRONOUS DETECTOR
16
L+R ENVELOPE DETECTOR
13
AGC DETECTOR
LIMITER
17
IF STAGE
12
RF STAGE
11
10
V.C.O.
25
LOW PASS FILTER
24
LIMITER
30
LOW PASS FILTER
31
PHASE DETECTOR
23
20

AM STEREO RECEIVER WITH IMPROVED CORRECTION SIGNALS

BACKGROUND OF THE INVENTION

This invention relates to the field of AM receivers for receiving compatible stereo signals and more particularly to the prevention of distortion generated when the received signal is essentially a left or right signal only.

Since a stereo broadcast signal must be receivable without distortion by monophonic receivers, the signal should have only monophonic information on the envelope of the carrier. It must, however, contain sufficient information to enable stereo receivers to decode the broadcast signal and produce the original, undistorted stereo signals. Such a signal, with transmitters and receivers for utilizing it, is described in a co-pending application Ser. No. 674,703, assigned to the same assignee as is the present application. This signal, for broadcasting two independent signals which could be left and right stereophonic signals, is of the form $(L+R)\cos(\omega_c t+\phi)$ where $\phi$ is arc tan $[(L-R)/(1+L+R)]$. A correction factor proportional to $\cos\phi$ is used to restore the original difference signal. This correction factor can be produced by coupling an amplitude limited signal to a phase lock loop as described in the above-referenced patent application. If, however, the broadcast signal contains left or right information only for any period of time, the correction factor may include a static phase error. It is desirable to prevent such an error from being introduced into the correction factor as it could produce distortion in the corrected signals.

SUMMARY

It is therefore an object of this invention to eliminate a possible source of distortion in a compatible AM stereo receiver.

It is a more particular object to prevent distortion in such a receiver when receiving a left or right signal only.

These and other objects are provided in a receiver for receiving a signal of the form $(L+R)\cos(\omega_c t+\phi)$ and utilizing a limiter coupled to a PLL for providing a cosine correction factor. In the PLL, the output of the phase detector could, under certain signal conditions such as a continuous left signal only, have a large DC component. If the output of the phase detector is limited to remove the large scale excursion produced during periods of left or right only transmission, then filtered in a very lowpass filter, the output of the filter is a DC voltage proportional to the angle $\phi$ of the broadcast signal. When this DC voltage is used to control the VCO, no perceptible static phase error is introduced into the $\cos\phi$ correction factor.

BRIEF DESCRIPTION OF THE DRAWING

In the drawing is shown a block diagram of a receiver for receiving a compatible AM stereo in accordance with the invention.

DETAILED DESCRIPTION OF THE PREFERRED EMBODIMENT

Before the receiver of the drawing figure is described, the transmitted signal and the transmitter for providing the signal will be explained. More detail may be obtained by reference to the above-referenced patent application if desired. Two carriers in quadrature, i.e., $\cos\omega_c t$ and $\cos(\omega_c t+\pi/2)$ are separately modulated with sum $(1+L+R)$ and difference $(L-R)$ signals to produce a signal of the form $\sqrt{(1+L+R)^2+(L-R)^2}\cos(\omega_c t+\phi)$ where $\phi$ is arc tan $[(L-R)/(1+L+R)]$.

The above signal is limited to remove amplitude modulation, leaving a signal of the form $k\cos(\omega_c t+\phi)$ where k is a constant large enough to prevent negative modulation. This phase modulated carrier is then amplitude modulated with $(L+R)$ in a power amplifier stage, to provide the compatible signal.

The present invention may be included in a receiver of the type described and claimed in co-pending application Ser. No. 837,258, although it is not limited to such a receiver.

In the drawing, such a similar receiver is shown also including the present invention. Broadcast signals received at an antenna 10 are processed in RF stage 11 and IF stage 12. The output of the IF stage 12 is coupled to an L+R envelope detector 13, the output of which is L+R and is coupled to a matrix 14.

The IF stage output is also coupled to an L−R synchronous detector 16 and the limiter 17. The output of the limiter 17 is a signal proportional to the stereo phase information of the transmitted signal and this output is coupled to a phase locked loop (PLL) 20 and the cosine phase detector 22. The PLL 20 includes a phase detector 23, lowpass filter 24 ($\simeq$5 Hz) and voltage controlled oscillator 25. In normal operation, i.e., with both L and R present in the transmitted signal, the output of the PLL 20 is a signal having the phase of the unmodulated carrier. The output of the phase detector 23 is a product of the IF stage 12 output and the VCO 25 output, or $\cos(\omega_c t+\beta t)+\cos(\omega_c t-\beta t)$ where $\beta t$ is the free running frequency of the VCO 25 and $\omega_c t\simeq\beta_c t$. The higher frequency term is dropped out in the lowpass filter 24 and only the difference term remains. The filter 24 output is coupled to control the VCO 25 and a $\sin\omega_c t$ output of the VCO 25 is coupled back to the phase detector 23. The VCO control voltage will vary along the portion of a sine curve, and if the VCO 25 tries to drift in frequency, the control voltage at the input will vary so as to maintain the desired frequency and phase relationship.

The $\cos\omega_c t$ output of the PLL 20 is the reference frequency signal and it is coupled to the cosine phase detector 22. The cosine phase detector determines the angle $\phi$, the instantaneous angle of the vector sum of the sum and difference signals in the stereo transmission. The output of the L−R synchronous detector 16 is proportional to $(L-R)\cos\phi$ and the output of the cosine phase detector 22 is proportional to $\cos\phi$. Processing these two signals in a divider 26 produces the corrected L−R signal which is coupled to the matrix 14 through a stereo/mono mode switch 27. Mode switch 27 may be controlled in a number of ways including the use of the cosine correction signal as filtered through a lowpass filter 28.

A problem may arise in such a system when the stereo signals consist essentially of a left or right signal only. Since $\phi$ is arc tan$(L-R)/(1+L+R)$, if L, for example is a single tone and R becomes zero for any period of time, $\phi$ becomes arc tan$(k\cos\omega_c t)/1+k\cos\omega_c t)$ and a DC component is introduced into the output of the phase detector 23 because of the asymmetric product. This DC component could drive the VCO 25 to a false phase relationship with the transmitter.

If the frequency reference signal from the VCO 25 is a false reference, the output of the L−R synchronous detector 16 will not be (L−R)cos $\phi$ and the output of the cosine phase detector 22 will not be cos $\phi$. Thus, the output of the divider 26 will be a distorted signal instead of undistorted L−R. In order to prevent the static phase error from occurring in the PLL, the output of the phase detector 23 is first limited in a limiter 30 to remove the large excursions present in the output of the phase detector, then coupled to the lowpass filter 24. It is preferable to add another lowpass filter 31 between the phase detector 23 and the limiter 30 to remove any RF on the detector 23 output. Such filtering will improve the operation of the limiter 30. With the addition of the limiter 30 and lowpass filter 31 to the PLL, when a stereo signal is transmitted having only or essentially only left or right information, the stereo signal is limited in the limiter 17 to remove the L+R information on the envelope of the carrier. The limited signal is multiplied by the oscillator 25 output and the product filtered in filter 31 to remove any RF signals. The filtered signal is clipped in the limiter 30 to remove large excursions, and again filtered to remove all signals except the proper DC voltages required to control the VCO 25. Thus a possible source of distortion has been removed from the receiver.

Other and equivalent ways of preventing this form of distortion are possible and it is intended to cover all such as fall within the spirit and scope of the appended claims.

What is claimed is:

1. An AM receiver for receiving compatible stereo signals and requiring dynamic correction for restoring the stereo information, comprising in combination:

input means for receiving the stereo signals and translating the carrier frequency to an intermediate frequency;

correction factor circuitry coupled to the input means and including;

first limiter means coupled to the input means for removing amplitude modulation from the received signal;

phase locked loop means coupled to the limiter means for deriving from the amplitude limited signal a frequency reference signal related to the carrier frequency, the phase locked loop means including a local oscillator;

and first phase detector circuitry coupled to the outputs of the first limiter circuitry and of the phase locked loop means for providing a stereo correction factor signal representative of the phase difference therebetween; and circuitry coupled to the phase locked loop means for preventing a false control voltage from being applied to the local oscillator.

2. An AM receiver in accordance with claim 1 wherein the phase locked loop means further includes second phase detector circuitry for detecting the phase modulation on the received signal and wherein the circuitry for preventing a false control voltage further includes second limiter circuitry coupled to limit the amplitude of the output of the second phase detector circuitry, and first filter means coupled to remove any audio frequency signals from the output of the second limiter circuitry.

3. An AM receiver in accordance with claim 2 and wherein the circuitry coupled to the phase locked loop further comprises second filter means coupled to remove any RF signals present in the second phase detector circuitry output, the filtered output being coupled to the second limiter circuitry.

4. An AM receiver for receiving compatible stereo signals and requiring dynamic correction for restoring the stereo information, comprising in combination;

input means for receiving the stereo signals and translating the carrier frequency to an intermediate frequency;

correction factor circuitry coupled to the input means and including;

first limiter means coupled to the input means for removing amplitude modulation from the received signal;

first phase detector means coupled to the limiter means for detecting the phase modulation on the received signal;

second limiter means coupled to limit the amplitude of the output signal of the first detector means;

first means coupled to the output of the second limiter means and having a low frequency passband for removing any audio frequency signals;

oscillator means coupled to the filter means for providing a frequency reference signal in response to the output of the filter means; and second phase detector means coupled to receive the outputs of the first limiter means and the oscillator means and to provide a correction signal which is a function of the phase difference therebetween.

5. An AM stereo receiver in accordance with claim 4, the correction factor circuitry further including second filter means coupled to remove RF signals from the input signal to the second limiter means.

6. An AM stereo receiver in accordance with claim 4 and further including third detector means coupled to the input means for detecting stereo information signals on the intermediate frequency signal; and divider means coupled to the second phase detector means and the third detector means for providing a substantially undistorted stereo output signal.

7. An AM stereo receiver in accordance with claim 6 and further including matrix means coupled to the divider means for providing separated stereo signals.

* * * * *